US005641959A

United States Patent [19]

Holle et al.

[11] Patent Number: 5,641,959

[45] Date of Patent: Jun. 24, 1997

[54] METHOD FOR IMPROVED MASS RESOLUTION WITH A TOF-LD SOURCE

[75] Inventors: Armin Holle, Oyten; Claus Köster, Lilienthal; Jochen Franzen, Bremen, all of Germany

[73] Assignee: Bruker-Franzen Analytik GmbH, Bremen, Germany

[21] Appl. No.: 619,005

[22] Filed: Mar. 21, 1996

[30] Foreign Application Priority Data

Dec. 21, 1995 [DE] Germany ..... 195 47 950.5

[51] Int. Cl.[6] ..... H01J 49/40

[52] U.S. Cl. ..... 250/287; 250/282

[58] Field of Search ..... 250/287, 286, 250/282

[56] References Cited

U.S. PATENT DOCUMENTS

| | | | |
|---|---|---|---|
| 4,442,354 | 4/1984 | Hurst et al. | 250/281 |
| 5,032,722 | 7/1991 | Boesl et al. | 250/287 |
| 5,160,840 | 11/1992 | Vestal | 250/287 |
| 5,210,412 | 5/1993 | Levis et al. | 250/287 |
| 5,510,613 | 4/1996 | Reilly et al. | 250/287 |

FOREIGN PATENT DOCUMENTS

| | | | |
|---|---|---|---|
| 3201264 | 7/1983 | Germany | 250/287 |
| 3842044 | 12/1988 | Germany . | |
| WO9420978 | 9/1994 | WIPO . | |

OTHER PUBLICATIONS

W. C. Wiley et al., *Time-of-Flight Mass Spectrometer with Improved Resolution, The Review of Scientific Instruments,* vol. 26, No. 12, pp. 1150–1157, Dec. 1995.

Johann M. Grundwurmer et al., *High-resolution mass spectrometry in a linear time-of-flight mass spectrometer,* International Journal of Mass Spectrometry and Ion Processes, vol. 131, pp. 139–148, 1994.

Eric D. Erickson et al., *Mass Dependence of Time-Lag Focusing in Time-of-Flight Mass Spectrometry—An Analysis,* International Journal of Mass Spectrometry and Ion Processes, vol. 97, pp. 87–106, 1990.

*Primary Examiner*—Jack I. Berman

[57] ABSTRACT

The invention relates to the use of a time-of-flight mass spectrometer to analyze substance molecules which are ionized by laser desorption, particularly by matrix-assisted laser desorption (MALDI). In detail it relates to the process for improving mass resolution by the known method of delayed acceleration of the ions in the space in front of the sample support plate. The invention consists of switching the potential of an intermediate electrode which is located at a short distance in front of the sample support plate, instead of switching the potential of the sample support plate itself.

8 Claims, 3 Drawing Sheets

METHOD FOR IMPROVED MASS RESOLUTION WITH A TOF-LD SOURCE

Figure 1:
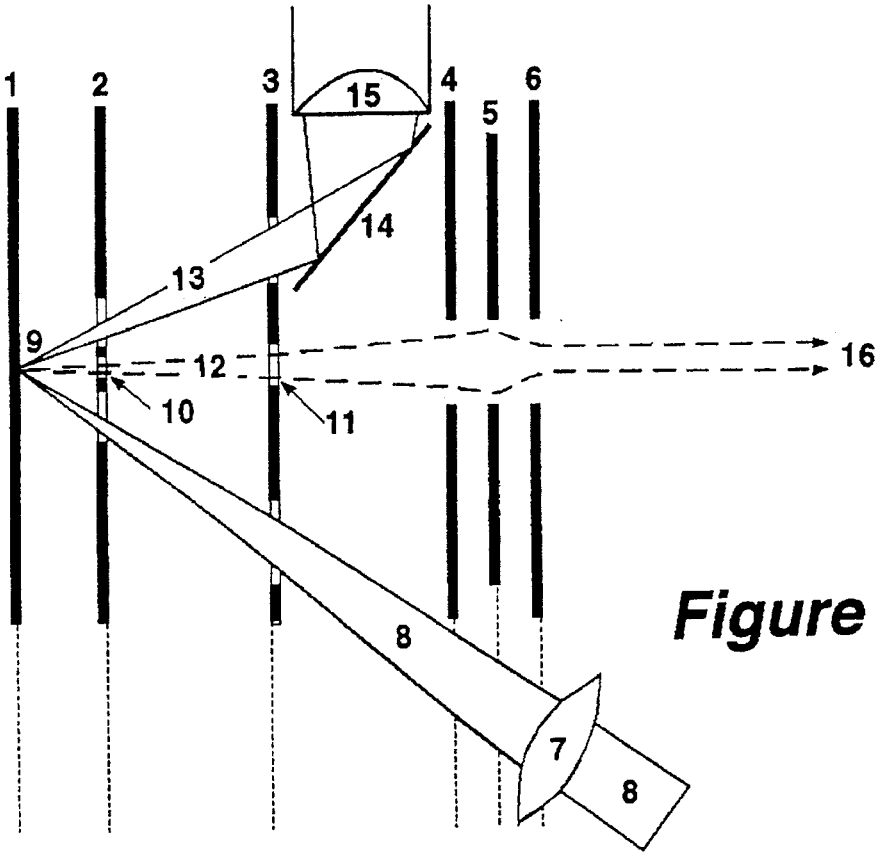

The invention relates to the use of a time-of-flight mass spectrometer to analyze substance molecules which are ionized by laser desorption, particularly by matrix-assisted laser desorption (MALDI). In detail it relates to the process for improving mass resolution by the known method of delayed acceleration of the ions in the space in front of the sample support plate. The invention consists of switching the potential of an intermediate electrode which is located at a short distance in front of the sample support plate, instead of switching the potential of the sample support plate itself.

PRIOR ART

The usual method of time-of-flight mass spectrometry with ionization by laser-induced desorption consists of creating a high electric acceleration field between the sample support electrode and a base electrode. The distance between both electrodes amounts usually to 10 to 20 millimeters; and a constant high voltage of 6 to 30 kilovolts is usually applied. A light pulse with a typical duration of about 4 nanoseconds from the laser which is focused on the sample surface generates ions of the substance molecules. The ions leave the surface with a large spread of initial energies and are immediately accelerated toward the base electrode through the electric field. The field-free drift section of the time-of-flight mass spectrometer is located in the flight tube region past the base electrode.

For the ionization of large sample molecules using matrix-assisted laser desorption (MALDI) the large substance molecules are deposited on the sample support in a layer of minute crystals of a low molecular matrix substance. The laser light pulse vaporizes a small amount of matrix substance, and the vapor cloud expands in a quasi-explosive process, whereby the large substance molecules are enclosed and accelerated by the vapor cloud. During initial vapor cloud formation, a small fraction of the molecules, both the matrix and the large substance molecules, are ionized. Ionization of the large analyte molecules continues during vapor cloud expansion by ion-molecule reactions with the smaller matrix ions. The vapor cloud expanding into the vacuum not only accelerates the molecules and ions of the matrix substance through its adiabatic expansion, but also the molecules and ions from the analysis substance through viscous friction. If the cloud expands without any acceleration by electric fields, the ions achieve average velocities of about 700 meters per second; the velocities are largely independent of the mass of the ions, but have a large velocity spread which extends from about 200 to 2,000 meters per second. It can be assumed that the neutral molecules in the cloud also possess these velocities.

The large spread of velocities with both types of laser-induced ionization limits the mass resolution of the time-of-flight mass spectrometers. Even if high acceleration voltages are used which tend to reduce the spread of initial velocities relative to the average velocity, the resolution of linear time-of-flight spectrometers is restricted to values of roughly $R=m/\Delta m\approx 600$. Even in time-of-flight mass spectrometers with energy-focusing reflectors the resolution is limited because here a spatial and temporal distribution for the generation of the ions by ion molecule reactions is additionally superimposed on the energy distribution of the ions, and such mixed distributions of start energies, start potentials and start times cannot be compensated with the reflectors simultaneously.

The fundamental principle for an improvement in the mass resolving power under such conditions of velocity spread has been known for more than 40 years already. The method together with its theoretical principles and an experimental confirmation has been published in the article W. C. Wiley and I. H. McLaren, "Time-of-Flight Mass Spectrometer with Improved Resolution", Rev. Scient. Instr. 26, 1150/1955

The authors termed the method "time lag focusing". More recently it has been examined under various names (for example "delayed extraction" or "pulsed ion extraction") in scientific articles relating to MALDI ionization. Recent publications such as R. S. Brown and J. J. Lennon, "Mass Resolution Improvement by Incorporation of Pulsed Ion Extraction in a Matrix-Assisted Laser Desorption/Ionization Linear Time-of-Flight Mass Spectrometer", Anal. Chem., 67, 1998, (1995)

R. M. Whittal and L. Li, "High-Resolution Matrix-Assisted Laser Desorption/Ionization in a Linear Time-of-Flight Mass Spectrometer", 67, 1950, (1995)

may be regarded as the status of current technology.

The principle of the method of improving resolution is simple: the ions of the cloud are allowed to fly at first for a brief time in a drift region without any electrical acceleration. The faster ions thereby separate themselves farther from the sample support electrode that the slow ones, and from the velocity distribution of the ions a location distribution results. Only then is the acceleration of the ions suddenly initiated through a homogeneous acceleration field, i.e. with a linearly declining acceleration potential. The faster ions have then further increased their distance from the sample support electrode, consequently, after the onset of the acceleration, they experience a somewhat reduced acceleration potential for acceleration, which results in a somewhat lower ultimate velocity for the drift section in the time-of-flight spectrometer than the ions which were initially slower. With correct selection of the time lag for the start of the acceleration, the initially slower, but after acceleration faster ions catch up to the initially faster, but after acceleration slower ions, directly at the detector. Ions of equal mass are consequently focused (in first order) at the location of the detector with respect to their time of flight.

As a result, it is no longer important whether the ions have already formed during the laser light pulse, or fight after this event in the expanding cloud through ion-molecule reactions, as long as this formation takes place within the time before the acceleration potential is switched on. Since the velocity of the molecules is virtually unchanged by the ion-molecule reactions, those ions which were released as initially fast neutral molecules are also focused by this method, and are only ionized later, though before electrical acceleration commences.

For reasons of good temporal resolution, time-of-flight spectrometers are operated at very high acceleration voltages of up to 30 kilovolts. The switching of such high voltages in extremely short times of only a few nanoseconds is still almost unattainable even today and is associated with high costs. The authors of the 1955 article have already shown however that the total acceleration voltage need not be switched, but that switching of a partial voltage suffices, requiring however the installation of an intermediate electrode in the acceleration path. Only the area between the sample support electrode and intermediate electrode need initially be field-free and then switched over into an acceleration field after a delay. The authors of the recent publications also use intermediate electrodes.

To switch on the acceleration field, so far it has always been the potential of the sample support electrode which has been over, and this was also the case with the authors of the recent articles. As will be realised, the switching range is dependent on the distance between the intermediate electrode and the sample support because for the same acceleration field the voltage difference is smaller, the smaller the electrode distance.

The term "high potential", or "high voltage" always refers, in this context, to a potential which repels the ions and therefore accelerates them towards the drift tube. It can be a high positive potential if the ions are positive and the drift tube is on ground potential, or it may be a high negative potential if the ions are negative. It may even be ground potential, if the drift tube is held at high positive or negative potential for the analysis of negative or positive ions, respectively.

Because quick switching of the voltage is technically all the easier to manage and all the more cost-effective, the smaller the voltage range, it is advantageous to position the intermediate electrode as closely as possible in front of the sample support electrode. Nevertheless there is also a lower limit for this distance, since the fastest ions must always remain in the drift region during the delay.

Since the fastest ions however only move at velocities of about 2,000 meters per second, and the delay according to the literature may only amount to about 1 microsecond at a maximum, the maximum flight path of the fastest ions during the field-free time lag is only about 2 millimeters. In practice, a distance of about 2 to 4 millimeters is selected between the intermediate electrode and the sample support electrode.

An intermediate electrode at such a short distance from the sample support however impairs access for the focused laser light beam. Since it is also desirable, as already offered in commercial mass spectrometers, to observe the sample during analysis via a microscope aided by a television camera, access for a light beam for illumination and a clear view of the sample are also impaired.

As prior art for this method, use of a large area, very transparent, meshed metal grid had therefore been introduced as an intermediate electrode, at a distance of about 3 millimeters from the sample support electrode. The meshed grid generates a very homogeneous acceleration field in front of the sample support electrode. The large area meshed grid allows the laser light pulse to also pass through this grid. Microscopic observation is also performed through this meshed grid. Both of the most recent cited articles use this type of meshed grid (see e.g. FIG. 1 in Brown and Lennon's article).

DISADVANTAGES OF THE PRIOR ART

However, switching the sample support electrode involves disadvantages.

On the one hand, the sample support electrode in commercial time-of-flight mass spectrometers has a relatively large and complex design because the sample support usually has to accommodate many samples which are to be fed to the analytical process one after the other by an x-y movement of the sample support. This large structure with a movement mechanism however produces a large electrical capacitance and it slows down switching.

On the other hand, switching the sample support electrode potential requires a very accurate voltage transition and a very constant final voltage. Any deviation will influence the energy of the ions, and becomes apparent in the form of a deviation in the mass of the ion on the mass scale. For consecutive additions of the spectra, this produces a widening of the mass signals, and thus a deterioration of the mass resolution. If, for example, the sample support electrode is switched from 22 to 30 kilovolts in 8 nanoseconds, the final voltage of 30 kilovolts has to be arrived at very accurately. A deviation of only ±3 volts, easily introduced by a hum, leads to a mass inaccuracy of $10^{-4}$. At a mass of 5,000 u for which one wishes to achieve a mass resolution R of at least 10,000, however, mass line shifts of ±⅕ mass units are intolerable; they do not permit the desired resolution.

OBJECTIVE OF THE INVENTION

A method is to be found for a favorable implementation of the known method for improving the resolution of time-of-flight mass spectrometers by delayed acceleration of the ions using desorption ion sources. The favorable implementation should permit fast switching cycles with low-cost switching electronics and has nevertheless to yield a good mass accuracy and mass resolution even if the switching cycles are repeated frequently.

DESCRIPTION OF THE INVENTION

It is the basic idea of the invention to switch the intermediate electrode instead of the sample support electrode. This electrode has a lower electrical capacitance and can therefore be switched very quickly even with relatively low-power supply units.

The potential to which this intermediate electrode has to be switched, is much less critical. An inaccuracy of the ultimate potential of the intermediate electrode has much less effect because, for example, it results in a slightly higher acceleration in front of the intermediate electrode and a slightly lower acceleration behind the intermediate electrode. The effect averages out in first approximation, and the error is only evident in higher approximations. The kinetic energy of the ions is sharply dependent on the potential of the sample support electrode which remains constant, and much less on the potential of the intermediate electrode.

This is very different from the situation of a potential change of the sample support plate because here the error takes full effect in the first approximation. The switching error here is fully reflected in the kinetic energy of the ions.

Switching the intermediate electrode becomes especially favorable when the sample support electrode is kept on ground potential, and the flight tube is on a high potential attracting the ions to be analyzed. The intermediate electrode then is first on ground potential, too, and then switched to a potential several kilovolts above ground. If a weak field is aimed for during the time lag, the potential of the intermediate electrode is only weakly deviating from ground.

SHORT DESCRIPTION OF THE FIGURES

FIG. 1 shows the ion source for the method of increasing mass resolution by delayed acceleration of the ions:

1=electrically conductive sample support electrode at constant high voltage potential

2=intermediate electrode, the potential of which is switched according to this invention

3=base electrode at ground potential

4,6 =external electrodes of the single lens, both at ground potential

5=center electrode of the single lens, at lens potential

7=focusing lens for the laser light pulse

8=beam of laser light pulse

9=sample application to the sample support

10=gridless aperture in the intermediate electrode
11=gridless aperture in the base electrode
12=ion beam, defocused by the apertures and focused by the lens
13=observation field of view
14=observation mirror
15=observation lens
16=ion beam in the flight tube of the time-of-flight mass spectrometer.

Figure 2A:
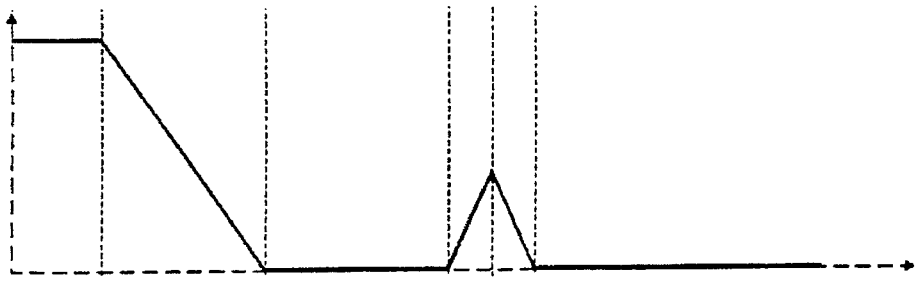

FIG. 2*a* shows the characteristic of potential from the sample support into the flight path for the time before acceleration, i.e. from the time of the laser light pulse up to the switching on of acceleration potential.

Figure 2B:
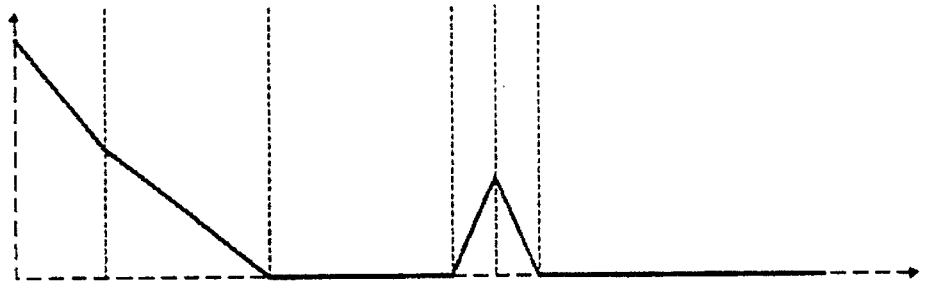

FIG. 2*b* shows the potential characteristic after switching on the acceleration voltage.

Figure 3:
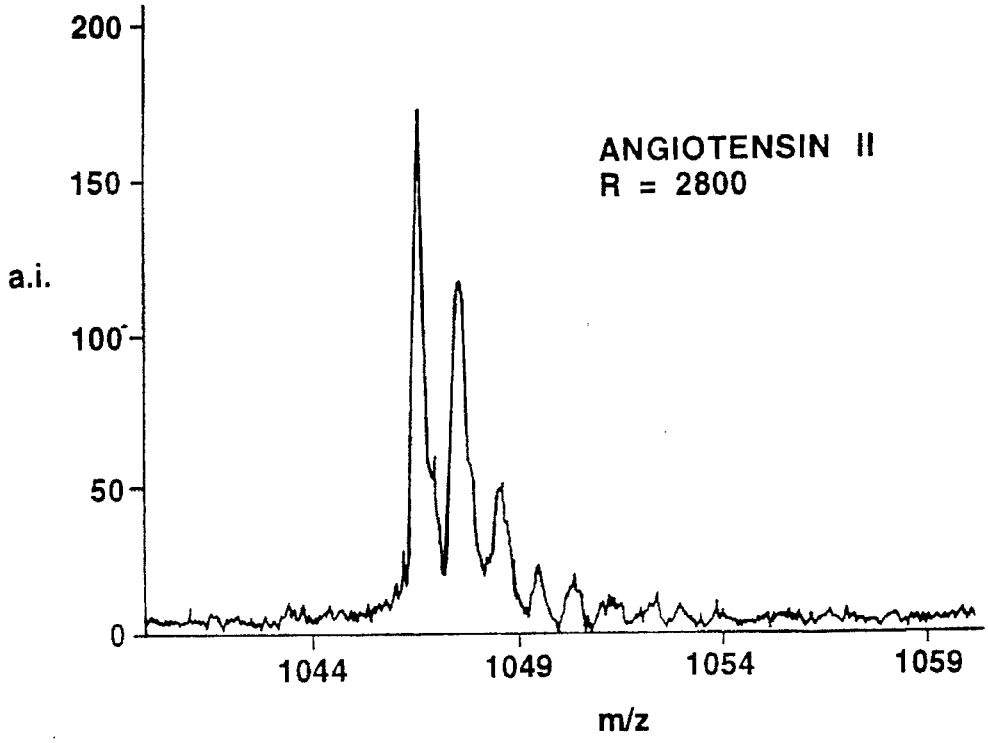
Figure 4:
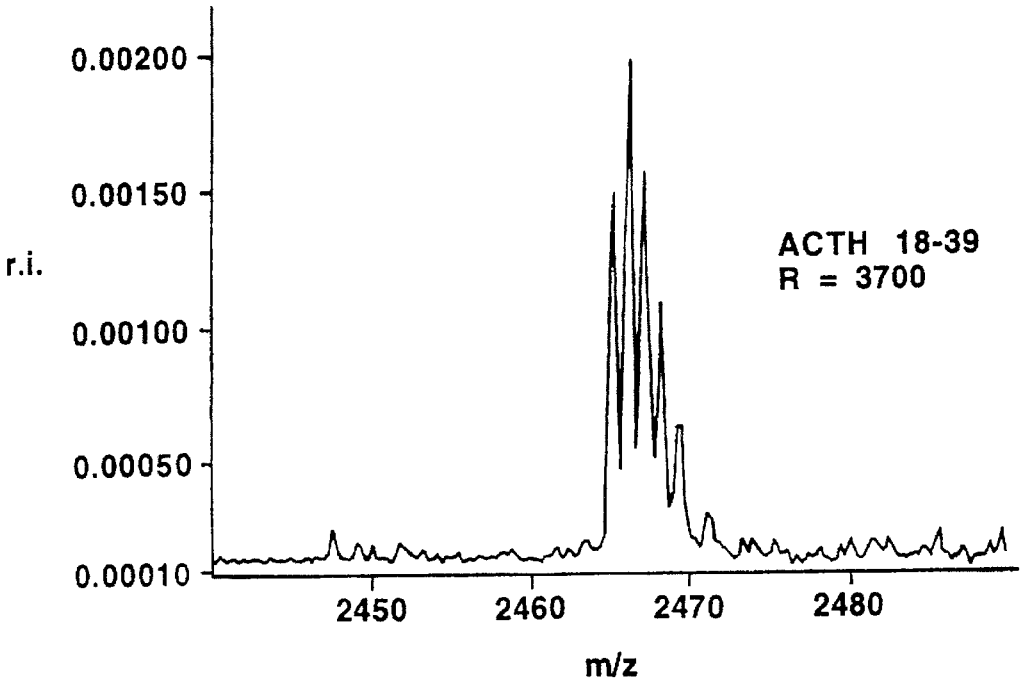
Figure 5:
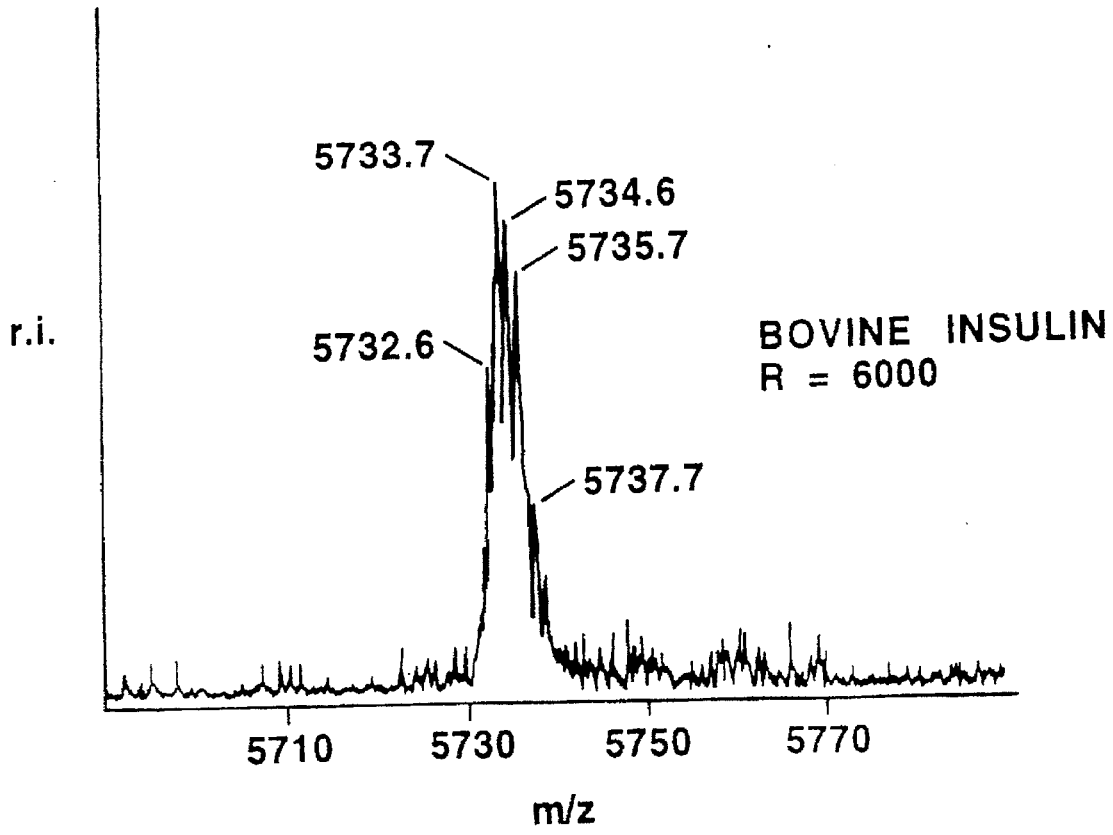

FIGS. 3, 4 and 5 show three scans of substances with very different molecular masses, which also produce different mass resolutions. Angiotensin II shows a resolution (R) of 2,800, ACTH 18–39 produces a mass resolution (R) of 3,700, and bovine insulin produces a resolution (R) of 6,000. All the scans were made with a linear time-of-flight spectrometer at a flight length of 1,6 meters. The resolution correspond to about 10 times that of what can be achieved by delayed acceleration without increasing resolution.

PARTICULARLY FAVORABLE EMBODIMENTS

A particularly favorable embodiment is shown schematically in FIG. 1. The sample substance 9 is applied, together with a matrix substance in the form of a thin crystal layer, on the surface of a sample support 1. The sample support can be brought through a vacuum lock into the vacuum of the mass spectrometer and contact is made automatically with the high voltage feeder (not shown) there. The sample support can be pushed using a moving device (not shown) parallel to its sample surface. In this way several samples 9 can be placed next to one another and analyzed one after another.

The ion source consists of sample support electrode 1, the intermediate electrode 2, the potential of which is switched according to this invention, and base electrode 3, which is at the potential of the flight tube. The flight tube (not shown) consists of the flight path of the time-of-flight spectrometer. It is generally at ground potential. At the beginning of the flight path, directly behind the base electrode, there is a single lens which consists of front electrode 4, terminating electrode 6, both at the potential of the flight tube, and the center electrode 5 at lens potential. To keep the lens voltage smaller for the same focusing effect, it has proved useful to make the center electrode thicker. Two center electrodes at the same potential can also be used. A complex design of single lens with several potentials, or even an arrangement comprising several single lenses is possible but it has not proved advantageous enough to justify the extra effort in terms of potential supply.

In this configuration the intermediate electrode 2 has a gridless, central, circular aperture 10, and the base electrode 3 has a centered, circular aperture 11. The accelerated ion beam passes through these apertures. The intermediate electrode and base electrode, however, can also be made of fine meshed, very transparent grids.

For performing the method the following dimensions have proved successful:

3 millimeters distance between sample support 1 and intermediate electrode 2;

1 millimeter diameter for aperture 10 in the intermediate electrode 2;

12 millimeters distance between intermediate electrode and base electrode;

2 millimeters diameter for aperture 11 in the base electrode 3;

8 millimeters distance between the base electrode and lens plate 4;

4 millimeters distance between each of lens plates 4, 5 and 6;

5 millimeters diameter for the apertures in each of lens plates 4, 5 and 6;

4 millimeters thickness for lens plate 5.

At the beginning of the procedure, sample support electrode 1 and intermediate electrode 2 are both at the high acceleration potential of about 30 kilovolts. Base plate 3 and the two lens plates 4 and 6 are at ground potential. The center electrode of the lens is at a previously optimized lens potential of about 10 to 15 kilovolts. The potential characteristic is shown in FIG. 2*a*. A slight improvement in the method can be achieved if the intermediate electrode is not located exactly at the high-voltage potential of the sample support but at a slightly different potential.

The sample is now irradiated by a brief laser pulse of about 4 nanoseconds in duration. The laser light pulse is focused by lens 7 onto a sample surface, resulting in light beam 8. The laser light pulse stems from a laser (not shown). Low-cost nitrogen lasers which produce light at a wavelength of 337 nanometers have proved particularly successful. A favorable dosage is at values of about $10^6 W/cm^2$.

As has already been described above, a small amount of matrix and sample substance vaporizes, forming a cloud which explosively expands adiabatically into the surrounding vacuum. Some ions from the sample substance form during the vaporization process, others form later in the cloud due to ion-molecule reactions in which the ions from the matrix are involved. Acceleration of all the molecules is essentially generated by the adiabatic expansion of the cloud which primarily consists of molecules from the matrix substance. The heavier molecules and ions from the sample substance are accelerated within the exploding cloud due to viscous entrainment, and therefore all the molecules and ions have about the same velocity distribution, ranging from about 200 to 2,000 meters per second, and reaching a maximum at about 700 meters per second. The cloud plasma is first neutral, since positive as well as negative ions, as well as some electrons, are present. Since the electrons quickly escape from the plasma, a slightly ambipolar acceleration of fringe ions takes place in the fringe areas which the escaping electrons generate between themselves and the remaining plasma. This effect is however minimal.

The process of the adiabatic expansion of the cloud lasts only about 30 to 100 nanoseconds, according to the density of the cloud. After this time, all contact between the molecule is lost due to the thinning of the cloud, and further acceleration no longer takes place. The velocity distribution is thereby frozen and there are no more ion-molecule reactions.

After a selectable time lag, the potential of the intermediate electrode is switched down to a new potential dependent on time lag, as shown in FIG. 2*b*. We use a potential supply which can be switched with a delay of 100 to 300 nanoseconds at a potential range of up to 5 kilovolts with a switching speed of 8 nanoseconds for the potential. Favorable values for raising resolution are at short time lags (approx. 120 nanoseconds) and high switching ranges (5 kilovolts). The required spread of ground potential achieved is considerably reduced by the invention and a spread at a magnitude of $5\times10^{-4}$ of switching range can still be tolerated. A high, reproducible switching speed (8 nanoseconds in our case), however, is important and must be maintained.

Until acceleration is switched on, the fast ions have flown further away from the sample support than the slow ones. When acceleration is switched on they are therefore at a lower potential and are no longer given the full acceleration by the high voltage. As already described above, this effect leads to a temporal focusing of ions of the same mass in a focus plane, the position of which can be set by time lag and acceleration field. If the location is accurately set to the ion detector, all the ions of the same mass arrive there simultaneously despite different initial velocities through the cloud and this therefore produces the desirable increase in mass resolution.

As already indicated above, the potential of the intermediate electrode does not necessarily have to be exactly at the high-voltage level of the sample support when the cloud is generated. It may be more favorable to have a weak field here. With slightly different potentials the penetration of the strong field between the intermediate electrode, and the base electrode can be minimized, on the one hand, by the aperture of the intermediate electrode and on the other, certain desirable effects can be generated by small fields in the space between the sample support and the intermediate electrode. In this way the above-mentioned ambipolar acceleration can be avoided by the escaping electrons. The light ions can be discriminated from the heavier ones by pushing them back. When switching over to the measurement of negative ions it has proved favorable to reoptimize this weak field.

In commercially available MALDI mass spectrometers it has now become possible to observe the sample on the sample support microscopically. The equipment for this is indicated in FIG. 1. It consists of a video camera (not shown) and a microscope, of which only object lens 15 is shown schematically. A mirror 14 directs observation at the sample. The illumination light (not shown) comes from the side.

For admitting a laser light pulse and illumination light and for observation purposes there are other apertures in the intermediate electrode in addition to the center aperture 10 for the ion beam. Depending on the angle of these beams there are also similar apertures in the base plate.

However, grids can also be used which admit laser light and illumination light, permitting observation. It is particularly favorable to use two apertures at fight angles to one another for illumination and observation in order to avoid reflections of light at the sample support plate into the microscope and to increase contrast.

The example given here of an ion source and a method according to this invention may naturally be varied in many ways. The specialist in the development of mass spectrometers, especially in the development of desorption ion sources, can easily implement these variations. For some applications it is favorable to have the flight tube on high potential, and the sample support electrode on ground. Introduction of the sample support into the vacuum system, and its movement in x-y directions, become much easier. Switching the intermediate electrode then becomes especially favorable because the sample support electrode can remain on ground potential. The intermediate electrode is on ground potential, too, during the laser shot, and then switched to a potential several kilovolts above ground. If a weak field is aimed for during the time lag, the potential of the intermediate electrode is only weakly deviating from ground.

FIGS. 3 to 5 show measurements of mass spectra with MALDI methods, which were scanned using delayed acceleration. The linear time-of-flight spectrometer has a length of 1 meter.

We claim:

1. Method for a high mass-resolution analysis, by a time-of-flight mass spectrometer with a flight tube, of substance samples 9 on a sample support electrode 1, with an ion source having a sample support electrode 1 on ion acceleration potential, an intermediate electrode 2, and a base electrode 3 on flight tube potential, comprising the following steps:

(a) setting the potential of the intermediate electrode to a potential very similar to that of the sample support electrode, (b) desorbing and ionizing the substance molecules by a laser light pulse 8, focused at the sample support electrode 1, (c) waiting for a selected time delay of several tens to hundreds nanoseconds, (d) starting the acceleration of the ions by switching the potential of the intermediate electrode 2 to a suitable potential while keeping constant the potential of the sample support electrode 1.

2. Method as in claim 1, wherein the intermediate electrode takes the form of a grid, at least at the center.

3. Method as in claim 1, wherein the intermediate electrode has a circular aperture through which the ions are drawn off.

4. Method as in claim 1, wherein the ionization is performed by matrix-assisted laser desorption and ionization (MALDI).

5. Method as in claim 1, wherein the potential of the intermediate electrode is set exactly to the potential of the sample support electrode in step (a).

6. Method as in claim 1, wherein a weak field strength between sample support electrode and intermediate electrode is maintained before switching on the main acceleration field.

7. Method as in claim 1, wherein the sample support electrode is at ground potential, and the flight tube is at high potential, attracting the ions to be analyzed.

8. Method as in claim 1, wherein the sample support electrode is at high potential, repelling the ions to be analyzed, and the flight tube is at ground potential.

* * * * *